United States Patent [19]

Heberle

[11] 4,179,012

[45] Dec. 18, 1979

[54] STAIRWAY-TYPE PASSENGER LIFT

[75] Inventor: Heinz Heberle, Friedberg-West, Fed. Rep. of Germany

[73] Assignee: Rigert Maschinenbau AG, Immensee, Switzerland

[21] Appl. No.: 901,106

[22] Filed: Apr. 28, 1978

[30] Foreign Application Priority Data

Apr. 29, 1977 [DE] Fed. Rep. of Germany ..... 2719120

[51] Int. Cl.[2] ..... B66B 9/08

[52] U.S. Cl. ..... 187/12; 187/17; 187/89

[58] Field of Search ..... 187/12, 13, 14, 17, 187/89

[56] References Cited

U.S. PATENT DOCUMENTS

| | | | |
|---|---|---|---|
| 1,237,627 | 8/1917 | Forbes | 187/17 |
| 1,873,807 | 8/1932 | Baldwin | 187/89 |
| 3,968,861 | 7/1976 | Kernen | 187/17 |
| 4,046,226 | 9/1977 | Flinchbaugh | 187/12 |

*Primary Examiner*—Robert R. Song
*Attorney, Agent, or Firm*—Karl F. Ross

[57] ABSTRACT

A stairway lift for use by an invalid or handicapped person has at the upper end of the stairs a drive sprocket, at the lower end of the stairs an idler sprocket, and a pair of tubular guides between the sprockets. An endless conveyor element in the form of a cable provided with a succession of closely spaced balls is displaceable within this guide and is connected to a carriage so that rotation of the drive sprocket can move this carriage up or down along the stairway. The idler sprocket is permanently connected to a centrifugal brake that stops displacement of the conveyor element whenever its speeds exceeds a predetermined maximum safe level. Furthermore the cable and the balls are relatively dimensioned so that the cable can transmit compressive forces to the idler sprocket and the brake in the event of cable rupture immediately above the carriage.

10 Claims, 8 Drawing Figures

1
2,3
5
6
5
5'
4
18
19
21
3
VII
2
20
15
17
5
5'
4

STAIRWAY-TYPE PASSENGER LIFT

FIELD OF THE INVENTION

The present invention relates to a lift. More particularly this invention concerns a passenger lift installable along a staircase for use by an invalid or handicapped person in ascending and descending the stairs.

BACKGROUND OF THE INVENTION

A passenger lift for transporting a person up and down a stairway is known which comprises a platform displaceable along a guide extending along the stairway. The platform is secured to an endless conveyor element that passes over sprockets or wheels at the upper and lower ends of the guide. One of these sprockets is connected to a drive motor which can be operated from the platform and also by means of limit switches at the end of the guide for controlling the direction of travel of the platform along the stairway.

It is an occasional problem with such devices that the conveyor element breaks. When this happens the platform normally slides rapidly down to the bottom end of the guide. In particular if the breaking of transport element occurs immediately above the platform does this present a dangerous situation. The possibility of injury is aggravated by the fact that the person using such a lift is normally an invalid or handicapped.

OBJECTS OF THE INVENTION

It is therefore an object of the present invention to provide an improved lift.

Another object is to provide such a lift which is safer in operation than the known type of lift described above.

SUMMARY OF THE INVENTION

These objects are attained according to the instant invention in a lift wherein the guides and conveyor element are relatively so dimensioned that lateral bowing of the element is impossible. Futhermore continuously engaging the transport element is a speed-responsive brake which completely arrests the transport element when it is displaced faster than a predetermined maximum speed.

This prevention of lateral bowing of the transport element, achieved principally by using a relatively stiff cable as the transport element and confining it in a relatively narrow tubular guide, in conjunction with the provision of a brake ensures that even if the cable ruptures above the platform, the brake will be effective as the relatively inextensible transport element will also be relatively longitudinally incompressible.

According to further features of this invention the conveyor element is formed as a relatively stiff cable along which are provided equispaced guide members normally in the form of balls. The spaces between these guide balls is at most equal to twice their diameter. The guide is formed as a pair of generally parallel tubes, one of which is formed with a thin longitudinally extending and radially throughgoing slot so that a lug secured to the respective stretch of the cable can extend through the slot and be connected to the passenger platform. It is also possible to separate these balls by further guide members constituted as spacers mainly and formed as oblate or flattened balls having convex sides turned toward the guide members, so that the cable of the conveyor element is provided with a continuous succession of longitudinally engaging guide members, thereby reducing its compressibility virtually to nothing. Such a construction is advantageous according to this invention where the speed-responsive brake is provided at the lower end of the guide in the stretch of cable extending from the platform down to the lower end when the platform is in the upper position. Only this portion of the transport element will be required in case of cable rapture to withstand compressive forces, as the rest of the cable will be merely tensioned.

The system according to the present invention therefore allows a very efficient layout to be used. The drive can be connnected to the sprocket at the upper end of the conveyor and the speed-responsive brake to the sprocket at the lower end. Thus the functions of the various parts of the apparatus can be equally divided between the mounting unit at the upper end and the mounting unit at the lower end for installation of the lift according to this invention in a standard staircase without taking up too much room.

In accordance with the instant invention the speed-responsive brake is of the centrifugal type and is directly provided on the idler sprocket at the lower end of the lift.

SPECIFIC DESCRIPTION

Figure 2:
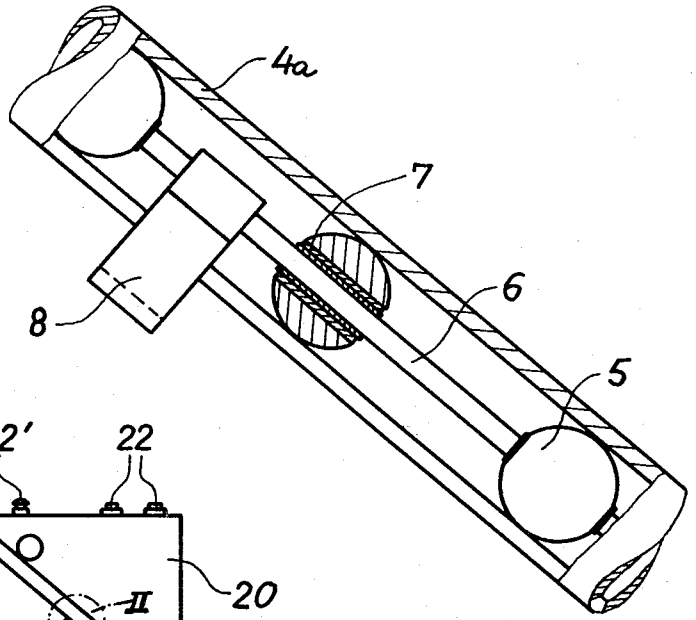
FIG. 2 is a large-scale view of the detail indicated at II in FIG. 1.
Figure 1:
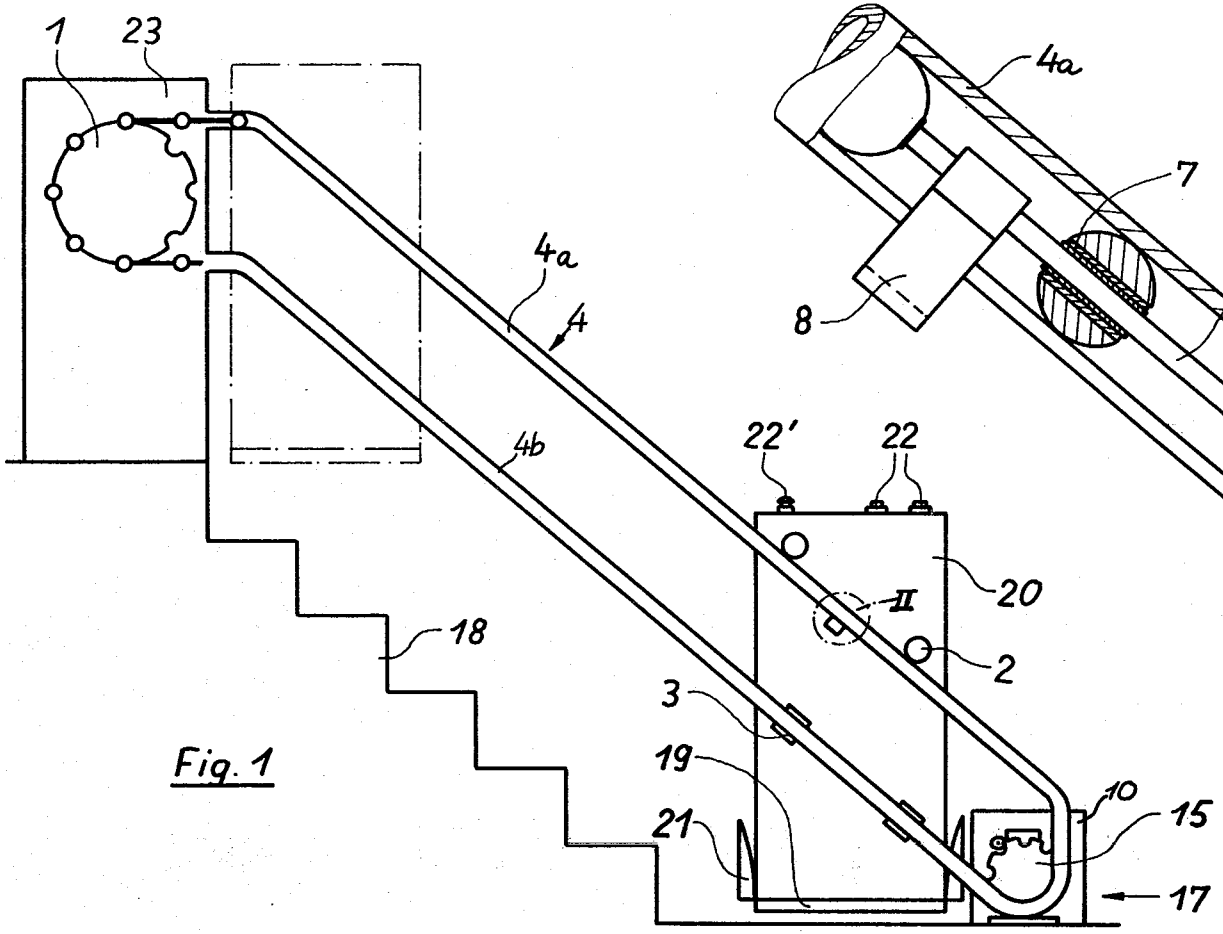
FIG. 1 is a side partly schematic view showing a lift according to this invention.

As shown in FIG. 1 a lift according to this invention extends upwardly along a stairway 18 and has a guide 4 constituted by a pair of parallel guide tubes **4*a* and 4*b* extending between a unit 23 fixed at the upper end of the stairs 18 and a unit 10 at the lower end of the stairs 18. A carriage 20 having a platform 19 and fold-down ramps 21 for a wheel chair or the like is guided by rollers 2 on the upstream guide tube 4*a* and by sliders 3 on the lower tube 4*b* for travel between the solid-line lower position and the dot-dash line upper position of FIG. 1**.

The guide 4 constitutes a closed annular path having two straight stretches defined by the tubes **4*a* and 4*b* and ending at the upper end at a drive sprocket 1 and at the lower end at a braking and idler sprocket 15. Reeved or engaged in these sprockets 1 and 15 is a conveyor element constituted as a heavy steel cable 6 formed into a closed loop and provided with a succession of guide members in the form of spherical balls 5 secured by means of relatively screwable collet-type locking sleeves 7 at locations equispaced along the cable 6 by a distance equal to no more than twice the diameter of the balls 5 which is also equal approximately to the internal diameter of the tubes 4*a* and 4*b*. A lug 8 is connected to the cable 6 and to the carriage 20 so that as the drive sprocket 1 actuated by a not illustrated motor is rotated counterclockwise as seen in FIG. 1 the carriage 20 moves upwardly and when rotated clockwise it moves downwardly. Buttons 22 controlling the upward and downward movement of the carriage 20 are provided thereon as well as an emergency or stop button 22'**.

Figure 3:
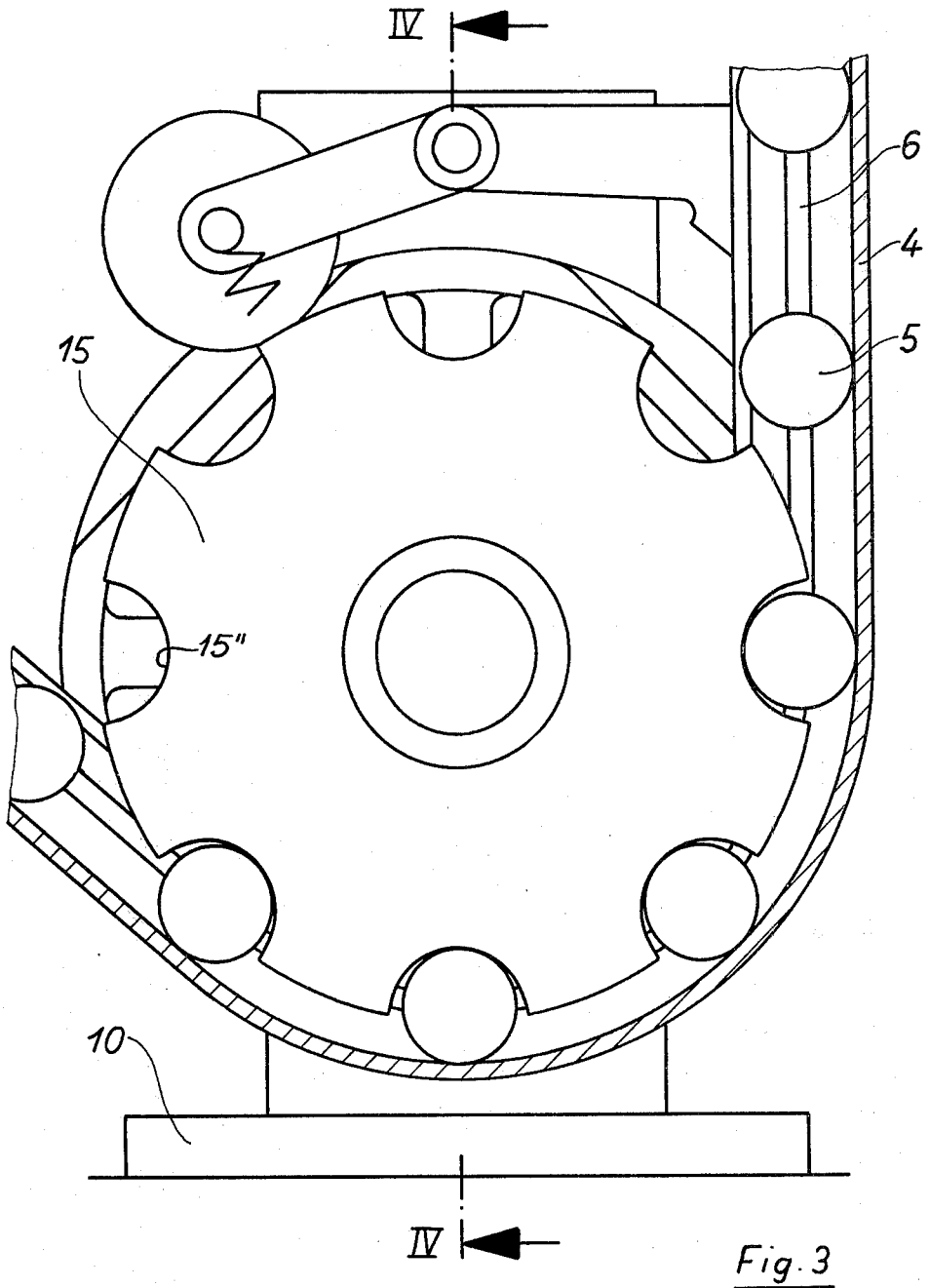
FIG. 3 is a large-scale sectional view through a detail of FIG. 1.
Figure 4:
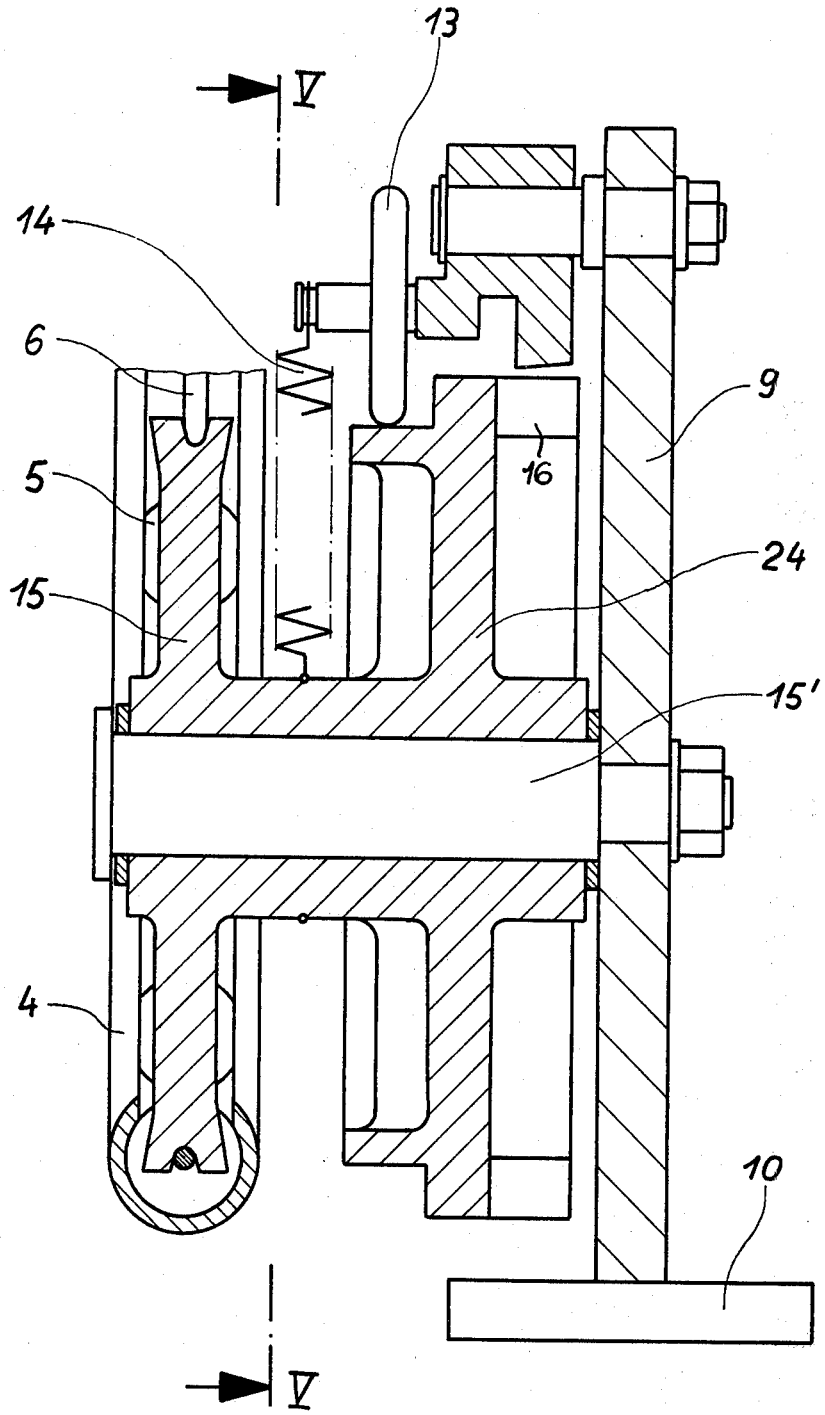
FIG. 4 is a section taken along line IV—IV of FIG. 3.
Figure 5:
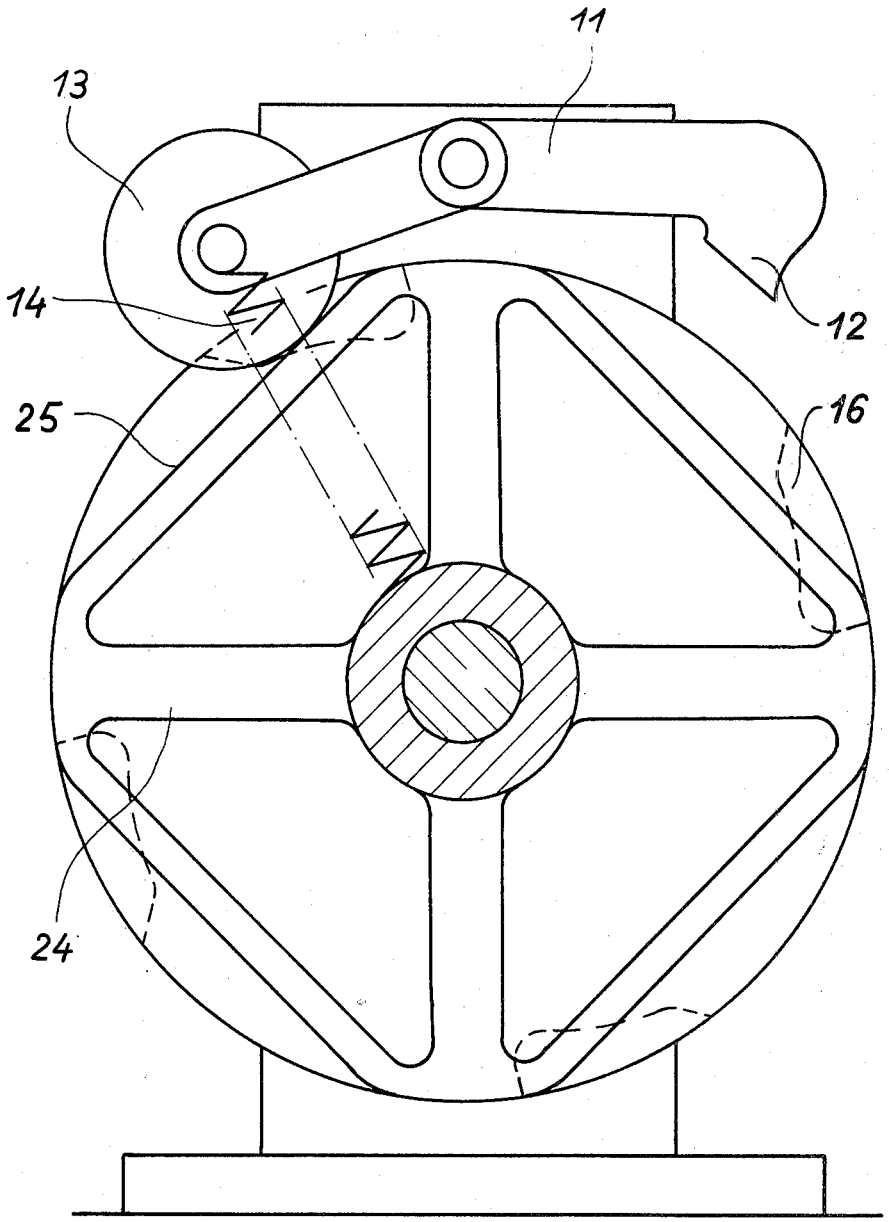
FIG. 5 is a section taken along line V—V of FIG. 4.

As best seen in FIGS. 3–5 the lower idler sprocket 15 is rotatable on a fixed shaft 15' carried on an upright 9 extending from the base unit 10 and is formed with cutouts 15" spaced angularly apart by a distance equal to the spacing between the balls 5 and dimensioned to loosely receive these balls 5. This idler sprocket 15 is unitary with a flywheel 24 having an outer surface 25 of generally polygonal shape. A roller 13 carried on one end of a rocker 11 pivoted on the upright 9 is urged by a spring 14 into snug radial engagement with the faceted or polygonal surface 25 of the flywheel 24. The other end of the rocker 11 is constituted as a locking pawl engageable in recesses 16 of the flywheel 24 so that this structure constitutes a centrifugal locking arrangement 17.

As long as the carriage 20 is moving relatively slowly the rocker 11 will merely tip back and forth as the roller 13 rises up and down on the facets of the flywheel 24, without the pawl 12 entering any of the recesses 16. When, however, the rotation speed of the sprocket 15 and of the wheel 24 exceeds a predetermined minimum the centrifugal force effective in a direction opposite the force of the spring 14 will pivot the rocker 11 so far that the pawl 12 will enter one of the recesses 16 and instantly lock and stop the flywheel 24. This action will also immediately stop the idler sprocket 15 and also arrest the conveyor element and the carriage 20.

Since the cable 6 is supported at relatively close intervals by the balls 5 it will not be able to bend and compress significantly so that even if the cable 6 ruptures immediately above the carriage 20 compressive forces in the cable 6 will be effective to rotate the sprocket 15 beyond its predetermined limit speed and close the locking arrangement 17 to arrest the carriage 20.

Figures 6, 7:
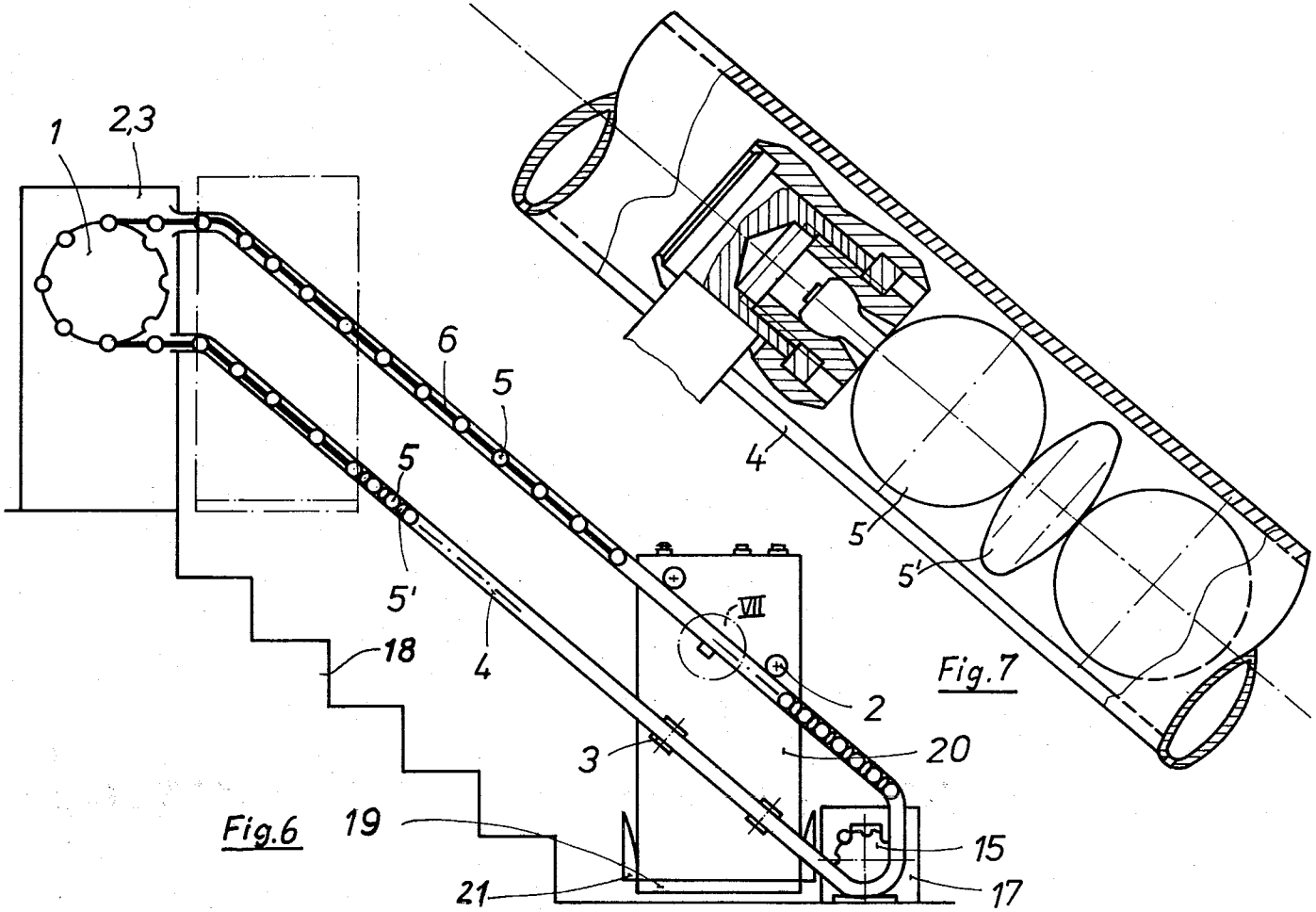
FIG. 6 is a side view similar to FIG. 1 showing another lift according to this invention.
FIG. 7 is a large-scale view of the detail indicated at VII in FIG. 1.
Figure 8:
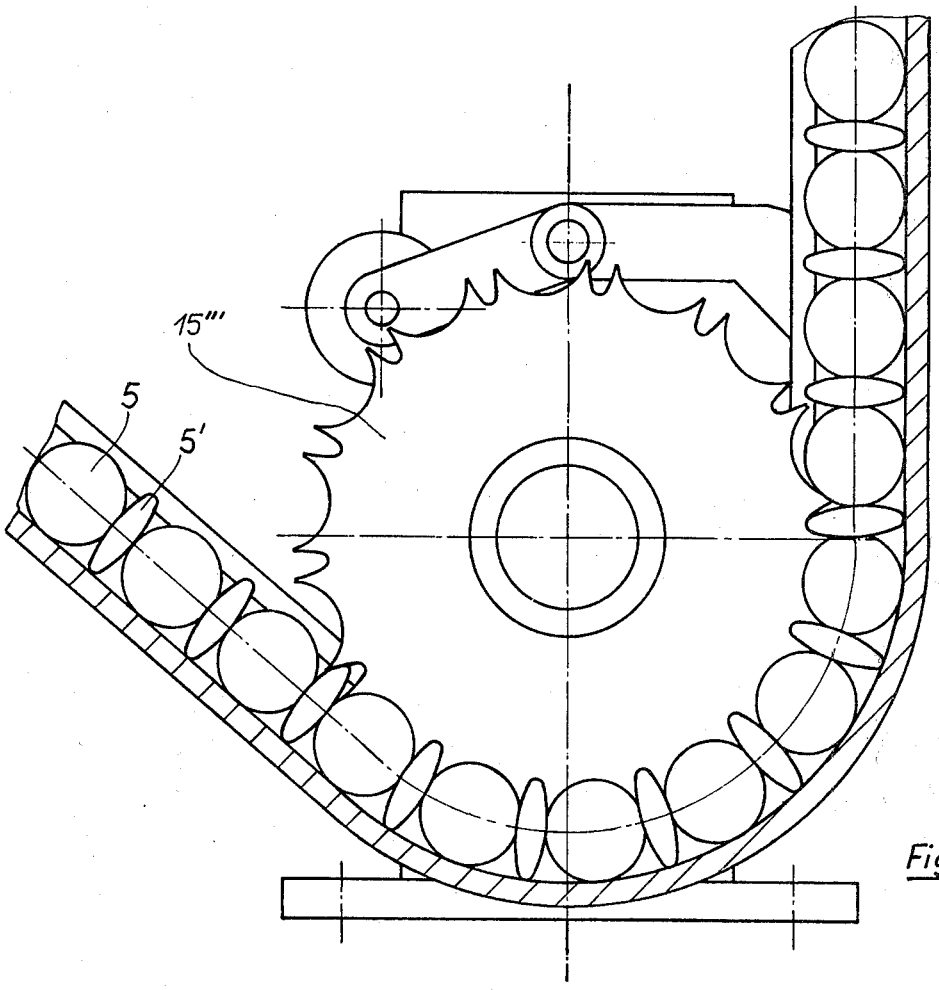
FIG. 8 is a large-scale sectional view through a detail of FIG. 6.

It is also possible as shown in FIGS. 6–8 to provide the cable 6 with further spacers 5' in the form of oblate or flattened balls so that the idler sprocket 15''' will be shaped as shown in FIG. 8. These spacers 5' need only be provided in approximately half of the conveyor element, that half behind and below the carriage 20 when it is in its uppermost position. These elements 5' can be shaped differently from the elements shown, as can be the elements 5, so long as their longitudinally directed contacting surfaces are convex. The use of a continuous row of such elements 5, 5' completely eliminates the compressibility of the conveyor element below the carriage 20 so that in the event of a cable break the carriage will be stopped instantly.

I claim:

1. A lift comprising:

a wheel;

an endless flexible and generally inextensible conveyor element reeved over said wheel;

a pair of guides extending from said wheel and receiving said element to subdivide same into a respective pair of stretches, said guides and element being relatively dimensioned to prevent lateral bowing of said element;

a platform fixed on one stretch of said element;

drive means connected to said element for displacing same and conveying said platform along one of said guides; and means including a speed-responsive brake in at least indirect continuous operative engagement with said element for arresting same when the displacement speed thereof exceeds a predetermined maximum level.

2. The lift defined in claim 1 wherein said guides are each a respective tube at a respective stretch, and said element is provided with longitudinally spaced balls each having an outside diameters generally equal to the inside diameter of the respective tube.

3. The lift defined in claim 2 wherein said balls are spaced apart along said element by a longitudinal distance equal to at most twice said outside diameter.

4. The lift defined in claim 2 wherein said element is provided with spacers interleaved with said balls, said balls and spacers being in continuous longitudinal contact with each other and having mutually engaging convex surfaces.

5. The lift defined in claim 4 wherein said balls are generally spherical and said spacers are oblate balls.

6. The lift defined in claim 1 wherein said wheel is a sprocket and said drive means is connected thereto.

7. The lift defined in claim 1 wherein the brake means includes a sprocket wheel over which said element is reeved and a centrifugal brake directly connected to said sprocket wheel.

8. The lift defined in claim 7 wherein said sprocket wheel is below the first-mentioned wheel and said drive means is connected to said first wheel.

9. The lift defined in claim 8 wherein said element includes a flexible cable and a plurality of guide members snugly slidable in said tubes and spaced apart along said cable, said cable further having rigid spacers between said guide members and engaging same in generally half of said cable in said one stretch below said cable when said platform is adjacent said first wheel.

10. The lift defined in claim 9 wherein said one stretch is above the other stretch.

* * * * *